United States Patent [19]

Quint

[11] Patent Number: 4,675,931

[45] Date of Patent: Jun. 30, 1987

[54] GANGWAY ASSEMBLY

[75] Inventor: Robert A. W. Quint, Gouda, Netherlands

[73] Assignee: Heerema Engineering Service B.V., AA Leiden, Netherlands

[21] Appl. No.: 748,592

[22] Filed: Jun. 25, 1985

[30] Foreign Application Priority Data

Jul. 10, 1984 [NL] Netherlands ..... 8402187

[51] Int. Cl.[4] ..... E01D 15/10

[52] U.S. Cl. ..... 14/71.1; 14/72.5

[58] Field of Search ..... 14/1, 2.4, 18, 8, 27, 14/19, 43, 69.5, 71.1, 72.5; 414/139; 182/36, 62.5, 63, 82; 212/219

[56] References Cited

U.S. PATENT DOCUMENTS 2,568,330 9/1951 Flippin ..... 14/71.3 X
3,228,051 1/1966 Voase et al. ..... 14/71.1
3,302,229 2/1967 Teague, Jr. ..... 14/72.5
3,385,455 5/1968 Dal Pont ..... 14/1 X
3,711,882 1/1973 Iller ..... 414/537 X
3,953,980 5/1976 Bennett ..... 14/18 X

*Primary Examiner*—James A. Leppink
*Assistant Examiner*—Matthew Smith
*Attorney, Agent, or Firm*—Fulwider, Patton, Rieber, Lee & Utecht

[57] ABSTRACT

Gangway assembly with a movable bridge part resting on a first surface, extending to a second surface, and connected between the two ends by at least one wire cable gripping the top end of a gantry carried by the first surface, the support of the first end being achieved via a carriage which can be moved over the first surface, the cable being guided over a first fixed pulley on the gantry and a second fixed pulley on the first surface, and with its other end being connected to the first end of the bridge.

4 Claims, 6 Drawing Figures

GANGWAY ASSEMBLY

The invention relates to a gangway assembly for spanning the distance between a first and a second surface, with a bridge part which rests with a first end, so as to be movable in the longitudinal direction, on the first surface, extends with the second end to the second surface, and which is connected between the two ends by at least one wire cable which grips the top end of a gantry carried by the first surface.

Such a gangway assembly is known from Dutch Patent Application No. 6,715,791. With this known gangway, it is in order to alter the distance to be spanned, necessary to adapt the length of the wire cable, which is cumbersome, especially if the gangway has to be returned from its fully extended to its fully retracted position, and it also necessitates the exercising of not inconsiderable force on the first end of the footbridge.

The object of the invention is to eliminate these disadvantages and produce a gangway assembly whose footbridge part can easily be moved in the horizontal direction without the wire cable having to be adjusted.

According to the invention in the support of the first end is achieved via a carriage which can be moved over the first surface while the cable is guided over a first fixed pulley on the gantry and a second fixed pulley on the first surface, and with its other end is connected to the first end of the bridge.

Guiding the wire cable in the manner described above means that during the horizontal movement the footbridge part always remains in the horizontal position without any adjustment of the wire cable being necessary for this.

Further advantageous embodiments of the invention are described in the subclaims.

The invention will be explained with reference to the drawing.

FIG. 1*a* is a side view of the footbridge assembly according to the invention, in a position for spanning a large distance between two surfaces;

FIG. 1*b* is a corresponding side view in the position for spanning a smaller distance between two surfaces;

FIG. 2 is a top view of the footbridge assembly according to the invention;

FIG. 3*a* is an end view of this footbridge assembly;

Figures 1A, 1B, 2:
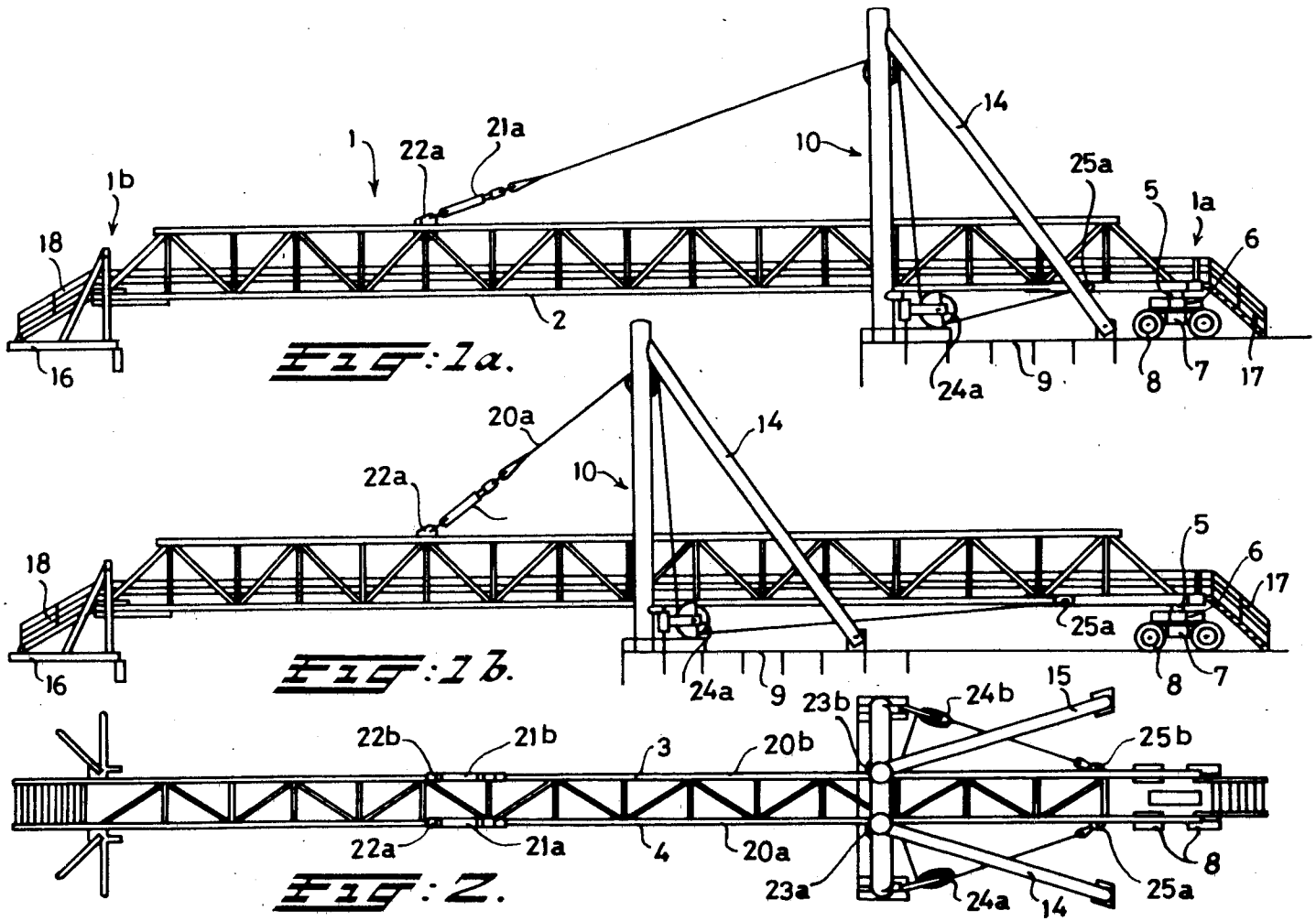
Figure 3:
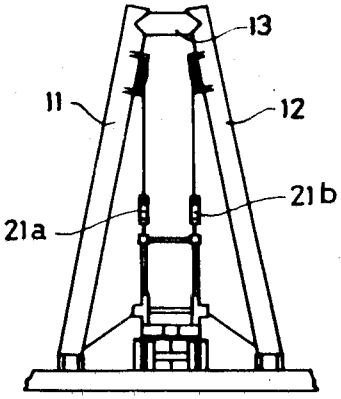

The footbridge assembly according to the invention comprises a footbridge part 1, made up of the gangway 2 and the upright sides 3, 4. The first end 1*a*, shown on the righthand side of the figure, rests via an articulated construction with a horizontal pivot 5 and a vertical pivot 6 on a carriage 7 provided with wheels 8. This carriage rests on a first supporting face 9, which also carries the gantry 10 with the upright posts 11, 12, the cross connection 13 and the struts 14, 15.

With the second end 1*b*, shown on the lefthand side of the figure, the footbridge is a short distance above a second surface 16. The footbridge is accessible from either side via steps 17 en 18, which are fixed by means of horizontal pivots to the respective ends 1*a* and 1*b*. The footbridge part 1 is carried not only by the carriage 7, but also by two cables 20*a*, 20*b*, which are each attached by one end (left in the figure) by means of a shock absorber 21*a*, 21*b* to the footbridge part at a place 22*a*, 22*b* which lies between the two ends; in the embodiments illustrated in the figure this place is situated about one third of the way from the left end. Both cables are guided over a first pulley 23*a*, 23*b*, which is located near the top end of the posts 11 and 12, and a second pulley 24*a*, 24*b*, which is situated near the lower end of the posts 10 and 11; the other free end of the cables 20*a*, 20*b* is attached at 25*a*, 25*b* to the footbridge part 1 near the righthand end 1*a*. Provisison is preferably made for several attachment points distributed over part of the length of the footbridge part 1, so that the length of the cable 20*a*, 20*b* is adjustable.

This special method of support means that when the footbridge part 1 is moved in the longitudinal direction the lefthand end 1*b* remains at practically the same vertical distance from the lefthand supporting surface 16. Small level differences are compensated for by the pivoted steps 17 and 18.

Figure 5:
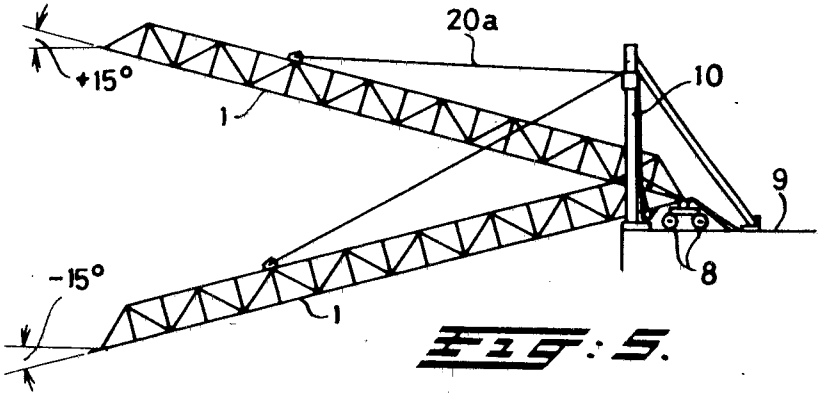
FIG. 5 is a schematic side view illustrating the level difference to be spanned by the end part of the footbridge.
Figure 4:
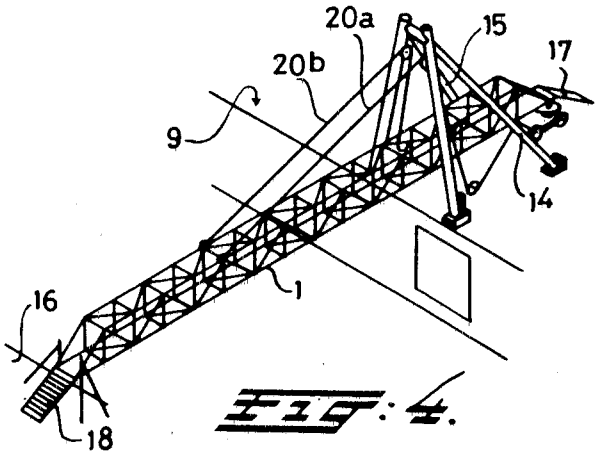
FIG. 4 is a schematic perspective illustration thereof.

Great level differences can be compensated for by varying the position of the gripping points 25*a*, 25*b* of the cables 20*a*, 20*b*. As FIG. 5 shows, in a particular embodiment the angular position of the footbridge part can be varied with respect to the horizontal over 15° in both directions.

I claim:

1. A gangway assembly for spanning the distance between a first and a second surface, said gangway assembly comprising:

a bridge part which rests with a first end on the first surface so as to be movable in a longitudinal direction with the second end extending towards the second surface;

a gantry carried by the first surface;

a carriage movable longitudinally over the first surface while supporting the second end thereof;

first fixed pulley on the gantry above the level of the bridge part;

a second fixed pulley on the first surface arranged below the level of the bridge part; and a cable connected to the bridge part at or adjacent the first end of the bridge part, which cable then extends over the first and second fixed pulleys and is then connected to the bridge part towards the second end thereof so that the tension in the cable acts to pull down the first end of the bridge part onto the first surface.

2. Gangway assembly according to claim 1, characterized in that a horizontal pivot and a vertical pivot are provided between the first end of the bridge part and the carriage.

3. Gangway assembly according to claim 1, characterized by two wire cables fixed to the bridge part on either side.

4. Apparatus for spanning the distance between two surfaces, means to mount the bridging means at a first end thereof on a first one of the surfaces for longitudinal movement towards and away from the second surface, and means to provide support for the second end of the bridging means, said support means including lower pulley means mounted fixedly relative to the first surface, upper pulley means mounted fixedly relative to the first surface and above the level of the bridging means, and cable means connected at one end to the bridging means at or adjacent the first end thereof, and which cable passes under the lower pulley means and over the upper pulley means and which cable is then connected at the other end to the bridging means towards the second end thereof, the cable means being placed under tension by the load from the second end of the bridging means, the lower pulley means being arranged below the level of the bridging means so that the tension in the cable means acts to pull down the first end of the bridging means onto the first surface.

* * * * *